United States Patent [19]

Lin et al.

[11] Patent Number: 4,734,350

[45] Date of Patent: Mar. 29, 1988

[54] POSITIVELY CHARGED DEVELOPER COMPOSITIONS WITH MODIFIED CHARGE ENHANCING ADDITIVES CONTAINING AMINO ALCOHOLS

[75] Inventors: John W-P. Lin; Paul C. Julien; Lesley P. Dudek, all of Webster, N.Y.

[73] Assignee: Xerox Corporation, Stamford, Conn.

[21] Appl. No.: 947,080

[22] Filed: Dec. 29, 1986

[51] Int. Cl.[4] ..... G03G 9/10

[52] U.S. Cl. ..... 430/110; 430/111; 428/404

[58] Field of Search ..... 430/110, 111; 428/404

[56] References Cited

U.S. PATENT DOCUMENTS 4,618,556 10/1986 Takenouchi ..... 428/404 X

FOREIGN PATENT DOCUMENTS

| | | |
|---|---|---|
| 79454 | 6/1980 | Japan . |
| 135854 | 10/1980 | Japan . |
| 57-07951 | 5/1982 | Japan . |
| 79952 | 5/1982 | Japan . |
| 57-78550 | 5/1982 | Japan . |
| 129446 | 8/1982 | Japan . |

*Primary Examiner*—J. David Welsh

*Attorney, Agent, or Firm*—E. O. Palazzo

[57] ABSTRACT

An improved positively charged developer compositions comprised of toner compositions containing resin particles, pigment particles and modified charge enhancing additives comprised of flow aid compositions having chemically bonded thereto, or chemiadsorbed on the surface thereof amino alcohol derivatives comprising at least one hydroxyl group, and at least one amino substituent selected from the group consisting of primary amines, secondary amines, and tertiary amines; and carrier particles.

27 Claims, No Drawings

POSITIVELY CHARGED DEVELOPER COMPOSITIONS WITH MODIFIED CHARGE ENHANCING ADDITIVES CONTAINING AMINO ALCOHOLS

BACKGROUND OF THE INVENTION

This invention is generally directed to toner compositions, and more specifically the present invention is directed to positively charged developer compositions, including magnetic, and colored developer compositions containing certain charge enhancing additives. In one important embodiment of the present invention, the charge enhancing additives are formulated by the chemical modification and/or chemical adsorption of known additives onto the surface of various flow aid compositions, inclusive of colloidal silicas, and small particle size alumina such as aluminum oxide. Developer compositions with the modified charge enhancing additives of the present invention are useful for causing the development of electrostatic latent images including color images. More specifically, positively charged toner compositions containing the aforementioned modified charge enhancing additives are particularly useful in electrostatographic imaging systems having incorporated therein a silicone fuser roll or a Viton coated fuse roll since these additives can be employed in small quantities and do not react substantially with Viton or silicone causing undesirable decomposition thereof, which adversely affects image quality and service life of the fuser roll. Also, compositions with the chemically treated additives of the present invention possess improved admix characteristics, and enable colored toner compositions with rapid charge exchange. Additionally, the modified additives selected for the toner and developer compositions of the present invention generally possess a large surface area, that is in some instances of about 50 to 400 $m^2$ per gram; and are of a small particle size with a diameter of, for example, about 7 to about 200 nanometers enabling the particles to easily acquire positive triboelectric charges on contact with the appropriate carrier particles. In addition, the aforementioned flow aids, especially the colloidal silicas, are of low cost and are readily available. Furthermore, the modified charge enhancing additives of the present invention are primarily white in color, and thus will not effect to any extent the coloration of the final toner composition. In addition, the aforementioned modified charge control additives in most instances do not melt upon fusion of the toner, and can in some embodiments permit nonglossy images on paper after fixing. Moreover, the surfaces of the flow aids, especially the silicas, contain thereon acidic silanol groups which are polar enabling the chemical reaction thereof with various bases, including amines, amino alcohol derivatives and compounds which are reactive with hydroxyl groups. Additionally, toner formulations with the charge enhancing additives of the present invention have substantially no adverse blocking characteristics, increased flowability, and they can be selected as magnetic toners without affecting the magnetic properties thereof.

Developer compositions containing charge enhancing additives, especially additives which impart a positive charge to the toner resin are well know. Thus, for example, there is described in U.S. Pat. No. 3,893,935 the use of certain quaternary ammonium salts as charge control agents for electrostatic toner compositions.

There is also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica. Further, there are disclosed in U.S. Pat. No. 4,338,390 developer and toner compositions having incorporated therein as charge enhancing additives organic sulfate and sulfonate compositions.

Other patents disclosing positively charged toner compositions with charge enhancing additives include U.S. Pat. Nos. 3,944,493; 4,007,293; 4,079,014; and 4,394,430. Additionally, there are disclosed in Japanese Patent Publication No. 154942 developer compositions having incorporated therein micropowders of silicates treated with aziridines derivatives. Further, in Japanese Patent Publication No. 59-137305 there is disclosed for incorporation into toner compositions silica treated with hydroxy ethylene amine followed by a silane treatment to obtain a hydrophobic material. Furthermore, the preparation of hydrophobic silanes by a silation process is illustrated in German Patent Publication DE No. 3330380. Other prior art includes Japanese Patent Publication No. 57079952 which discloses a positively charged control agent containing silicate micropowder treated with aziridine; Japanese Patent Publication No. 7078-556 wherein there is disclosed a positive charge control agent containing a silicate micropolymer treated with one or more aziridines; Japanese Patent Publication No. 55136-84 which discloses an electrostatic latent image developer containing a charge control agent which may be comprised of microparticles of colloidal silica that can be present in a monoazo dye complex, reference FIGS. 1 and 2; and Japanese No. 57078-550 wherein there is described a developer containing a silicate micropowder as a positive charge control agent.

Additionally, there is illustrated in copending application Ser. No. 891,836, entitled Toner Compositions With Modified Charge Enhancing Additives, the disclosure of which is totally incorporated herein by reference, an improved toner composition comprised of resin particles, pigment particles, and present on the surface thereof additives comprised of a charge enhancing component sorbed on a flow aid composition.

Moreover, there is disclosed in U.S. Pat. No. 4,298,672 positively charged toner compositions containing resin particles and pigment particles, and as a charge enhancing additive alkyl pyridinium compounds, inclusive of cetyl pyridinium chloride. While the developer compositions disclosed in the U.S. Pat. No. 4,298,672 are sufficient for their intended purposes, it appears that the alkyl pyridinium compounds involved react with the polymer coated on Viton fuser rolls causing decomposition thereof. Also, several of the other charge control agents disclosed in the prior art interact with certain fuser rolls, such as Viton fuser rolls, used in electrostatographic systems. This interaction causes the fuser roll to be adversely affected resulting in deterioration of the image quality. For example, Viton fuser rolls discolor and turn black, develop multiple surface cracks and harden when certain charge control additive compounds are contained in the toner mixture.

A Viton fuser roll selected for use in electrostatographic copying machines is comprised of a soft roll fabricated from lead oxide, and duPont Viton E-430 resin, a copolymer of a vinylidene fluoride, and hexafluoropropylene. This roll contains approximately 15 parts of lead oxide, and 100 parts of Viton E-430, which mixture is blended and cured on the roll substrate at elevated temperatures. Presently, the function of the lead oxide is to generate some unsaturation by dehydrofluorination for crosslinking, and to provide release mechanisms for the toner composition. Excellent image quality has been obtained with Viton fuser rolls, however, in some instances there results a toner fuser compatibility problem when unstable charge control agents are part of the toner mixture. For example, it appears that certain specific charge control additives, such as quaternary ammonium compounds and alkyl pyridinium compounds, including cetyl pyridinium chloride, react with the Viton of the Viton fuser roll. For example, cetyl pyridinium chloride, when part of the toner mixture, appears to be catalytically decomposed by the lead oxide contained in the fuser resulting in a highly unsaturated compound, which polymerizes and condenses with the unsaturated Viton E-430 material. In view of this, the Viton fuser roll turns black, develops multiple surface cracks, and the surface thereof hardens thereby resulting in image quality deterioration. Therefore, there remains a need for affecting the reduction of the amount of chemically and thermally unstable charge enhancing additives in toner formulations, which is achieved with the invention of the present application.

Toner compositions containing many of the above described charge enhancing additives are useful for causing the development of images formed on single, or layered photoresponsive imaging devices comprised of generating layers and transport layers thereby requiring a toner composition that is positively charged in order that the toner particles may be suitably attracted to the electrostatic latent image contained on the photoreceptor surface. These devices usually are charged negatively rather than positively as is the situation with selenium photoreceptors. Thus, efforts have been devoted to obtaining developer compositions containing toner resins which are positively charged. Thus, while many charge control additives are known, there continues to be a need for new additives. Specifically, there continues to be a need for additives which will minimize the interaction with Viton type fuser rolls. Additionally, there continues to be a need for charge control additives which are thermally stable at high temperatures. Moreover, there continues to be a need for positively charged toner and developer compositions with rapid admix charging characteristics. Also, there continues to be a need for new charge enhancing additives, particularly those additives which can be economically prepared. Additionally, there is a need for additives which, in addition to being thermally stable, are substantially nontoxic. In addition, there is a need for efficient charge control additives which can be deposited on small particle surfaces to enable an enhancement of the charge transfer efficiency for the toner compositions selected. Further, there is a need for charge enhancing additives which can be easily and permanently dispersed in toner resin particles. Moreover, there is a need for colored toner compositions which contain positively charged particles, and wherein the resulting toner compositions have desirable toner admix charging, and narrow charge distribution values on the aforementioned compositions. There is also a need for toner compositions which can be selected for the development of colored images in electrophotographic imaging processes wherein there is utilized a minimum amount of charge enhancing additives. Additionally, there continues to be a need for toner and developer compositions wherein, subsequent to development, there results nonglossy colored images on paper or other substrates.

SUMMARY OF THE INVENTION

It is an object of the present invention to provide toner and developer compositions containing chemically modified charge enhancing additives with many of the above advantages.

In another object of the present invention there are provided positively charged toner compositions which are useful for causing the development of electrostatic latent images, including color images.

In yet another object of the present invention there are provided positively charged toner compositions containing nonfusable inorganic particles as charge enhancing additives.

A further object of the present invention is to provide charge enhancing additives which are thermally stable at high temperatures.

Another object of the present invention resides in the provision of chemically modified charge enhancing additives which do not strongly interact and/or attack Viton rubber selected for use in imaging systems containing certain fusing roll systems.

In another object of the present invention there is provided a developer composition containing positively charged toner particles, carrier particles, and chemically modified charge enhancing additives.

In yet a further object of the present invention there are provided positively charged toner compositions which are water insensitive and have desirable admix properties.

In a further object of the present invention there are provided magnetic toner compositions, and colored toner compositions containing positively charged toner particles, carrier particles, and modified charge enhancing additives.

These and other objects of the present invention are accomplished by providing developer compositions, and toner compositions comprised of resin particles, pigment particles, and chemically modified charge enhancing additives. In one embodiment of the present invention, there are provided single component toner compositions and improved positively charged developer compositions comprised of toner compositions containing resin particles, pigment particles, and modified charge enhancing additives comprised of flow aid compositions having chemically bonded thereto, or chemiadsorbed on the surface thereof amino alcohol derivatives comprising at least one hydroxyl group, and at least one amino substituent selected from the group consisting of primary amines, secondary amines, and tertiary amines; and carrier particles. Moreover, another embodiment of the present invention is directed to a developer composition wherein the modified charge enhancing additives chemically bonded or chemiadsorbed onto the surface of flow aid compositions are amino alcohols reacted with a component selected from the group consisting of an alkylating compound or a protonic acid enabling surface modified flow aid additives containing partially or completely substituted quaternary ammonium salts. Another embodiment of the present invention is directed to a developer composition wherein the charge enhancing additive moiety, which is chemically bonded or chemiadsorbed onto the surface of the flow aid compositions, is prepared by first treating the flow aid compositions with an amine containing silylating compound followed by the subsequent reaction thereof with an alkylating component or an acid component thereby enabling, attached to the surface of the flow aid, partially or fully reacted quaternary ammonium salts. Furthermore, the present invention relates to improved positively charged developer compositions wherein the charge enhancing additive moiety, which is chemically bonded to or chemiadsorbed onto the surface of the flow aid composition, is prepared by treating the flow aid composition with an epoxy-containing silylating agent; and thereafter, reacting the resulting composition with a primary amine or a secondary amine.

By chemically modified in accordance with the present invention is generally meant the chemical attachment and/or chemical sorption of charge enhancing additives onto the surface of various flow additives, inclusive of colloidal silicas, such as Aerosil aluminum oxides, and titanium oxide. More specifically, for example, commercially available alumina and synthetic silicas, inclusive of fumed silica, hydrophilic silica, partially silylated silica with alkyl silyl groups such as dimethyl silyl and trimethylsilyl groups, precipitated silicas, and other similar silicas containing silanol groups, such as ≡Si—OH; aluminum oxide comprising ≡Al—OH; and titanium oxides comprising ≡Ti—OH can also be chemically modified with amino alcohol derivatives thereby enabling a charge control additive which, for example, may be further modified with different alkylating components, inclusive of organic sulfates, organic sulfonates, organic halides, inorganic acids, organic acids, and the like, with the attached amine moiety thus yielding a product comprised of partially, less than 100 percent, or fully substituted quaternary ammonium salts. With further respect to the present invention, when all of the amine functional groups of the aforementioned amino alcohol derivatives are completely reacted with an alkylating agent, the corresponding fully substituted quaternary ammonium salts are obtained. Alternatively, when alkylation of the amino alcohol derivatives is not completed, that is less than 100 percent alkylation, there results a partially substituted quaternary ammonium salt which comprises a free amine moiety and quaternary ammonium salts present on the surface of the aforementioned flow aid.

Also, more specifically, by chemical adsorption or chemisorption is meant that the absorbant participates in a chemical interaction with the surface of the silicas, aluminas and titanium oxides to yield a heat of absorption, usually of the order of greater than 4K-cal/mole. This absorption may be disassociative, nondisassociative or reactive in nature. The amount of amino alcohols, amine, amine quarternary ammonium salts, and the like incorporated into the flow aid silicas, aluminas, and titanium oxides is dependent on, for example, the flow aid additive selected, the surface area thereof, and the surface hydroxyl group concentration. For example, therefore, Aerosil 200 which has a surface area of 200 meters$^2$ per gram, and wherein the hydroxyl surface concentration is about 1 milliequivalent per gram, the amount of amino alcohol amines, quaternary ammonium salts and the like utilized for modification varies from about 0.001 to about 1 millimole/gram of the Aerosil 200 and preferably from 0.2 to 1.0 millimole/gram. With Aerosil R974, about 60 percent of the surface hydroxyl groups have been methylated leaving about 40 percent of the surface hydroxyl groups for reaction or interaction, thus the amount of amino alcohols, amines, and the like utilized varies from about 0.001 to about 0.4 millimoles per gram of Aerosil R974; and preferably from 0.05 to 0.4 millimoles per gram.

The charge enhancing additives of the present invention are not easily removed from the flow aid additives, and in many situations the silanol peak of the silicas at about 3751 cm$^{-1}$ in the IR spectrum disappears after chemical modification suggesting either the reaction or interaction of the surface hydroxyl groups with modifying chemicals such as amino alcohol derivatives, amines, and silylation reagents as illustrated further hereinafter.

With further reference to the charge enhancing additives of the present invention, the surface silanol groups (≡Si—OH) can react with amino alcohol derivatives to form either silyl ethers (≡Si—OR) which contain amine moieties by elimination of water at high temperatures. Alternatively, the surface silanol groups can react with amine salts through the acidic silanol groups and amine bases. These reactions and interactions can occur rather rapidly, and as a result of the aforementioned acid base reactions the modified amines and amino alcohol derivatives can be firmly attached to the surface of various silicas, including hydrophilic and hydrophobic silicas, and thus become permanently attached to the silica particles. Accordingly, the amine moieties are preferably located on the surface of the silica particles, and upon contact with carriers present in the developer mixture, they quickly acquire a positive triboelectric charge for the toner particles. One primary advantage in the selection of amino alcohol derivatives for modification of the flow additives is that the hydroxyl groups on the alcohols permit hydrogen bonding with the surface silanol groups and siloxyl groups as well as with the surface hydroxyl groups present on the silica particles. Hydrogen bonding enables chemisorption of the modifying amines and amino alcohol derivatives on the surface of the silicas, and/or aluminum oxides thereby preventing the separation thereof from these flow aid additives.

Illustrative examples of flow aids which can be selected for modification include Aerosil, which materials may be hydrophobic, that is containing organo silyl groups; partially silylated with silylation agents, such as dimethyl dichloro silane, or trimethyl chloro silane; and other silanes such as those containing at least one reactive functional group which can react with the hydroxyl group. Alternatively, the flow aids selected can be hydrophilic. Specific examples of preferred flow aids include hydrophobic Aerosil R974 and Aerosil R976 available from Degussa Company, hydrophilic flow aids such as Aerosil 200, Aerosil 300, and the like.

In one specific method, the amine containing charge control additives can be prepared by dissolving an amino or amino alcohol derivative in an organic solvent, followed by the addition of the flow additive resulting in a uniform mixture, and subsequent heating and evaporation of the solvent. Although heating in some instances may not be necessary, it is selected to expedite the reaction between the surface hydroxyl group of the flow aid additives and the amine on the amino alcohol. Subsequent to the removal of the solvent and drying, the chemically treated flow aids can be optionally subjected the thermal, chemical and mechanical processes.

Examples of amino alcohol derivatives utilized are selected from the group consisting of

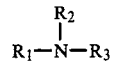

wherein $R_1$, $R_2$ and $R_3$ are independently selected from hydrogen, alkyl, substituted alkyl, aryl, particularly phenyl, substituted aryl, amino, heterocyclic groups, such as nitrogen, sulfur or oxygen, alkoxy, and cyclic functional groups subject to the provision that at least one of the aforementioned $R_1$, $R_2$ and $R_3$ substituents contains a hydroxyl group.

Illustrative examples of amine alcohol derivatives include primary, secondary and tertiary amines subject to the provision that these amines contain a hydroxyl functional group. Specifically, the aformentioned amine derivatives can be cyclic, noncyclic, aromatic, or monoaromatic compounds examples of which include the derivatives containing 2,2'-dipyridylamine; N,N-diethyl aniline; N,N-dibutyl aniline; 1,4-bis propyl piperazine; tetramethyl ethylene diamine; 2,6-diamino pyridine, hexylamine, dodecaamine 2-amino ethyl piperidine; and the like. In addition, the amino alcohol modified flow aid additives illustrated herein can be further treated with an alkylating component, or an acid material. The aforementioned treatment provides flow additives comprised of different quaternary ammonium salts on the surface thereof. The quaternization, either partially or completely, which quaternized products when incorporated into toner compositions enable, for example, an enhancement in the charge exchange rate between the toner particles, as much as two orders of magnitude can be accomplished by reacting the attached amine moiety with an alkylating component such as an organic sulfate, inclusive of dimethylsulfate, an organic sulfonate, such as methyltoluene sulfonate; or with, for example, a protonic or other acid. The acids that may be selected include hydrochloric, nitric, sulfuric, perchloric, boric, phosphoric, acetic, propionic, stearic, hexanoic, fumaric, benzoic, naphthoic, cinamic, succinic, and similar acids, providing the objectives of the present invention are achieved:

Specific examples of amino alcohols that can be utilized in the present invention include N,N-dimethyl amino ethanol; N,N-diethyl amino ethanol; 1-(4-methyl piperazino)propanol; N,N-dibutyl amino phenol; N,N-diethyl amino phenol; 4,4'-bis(dimethyl amino)benzyl alcohol; 4,4'-bis(dimethyl amino)phenyl benzylcarbinol; N-hydroxyl ethyl ethylene diamine; 2-morpholino ethanol; Malachite Green Carbinol base; and the like.

With further regard to the present invention, the modified charge additives can be prepared in another embodiment by reacting the surface hydroxyl groups of the silica or aluminas with a silylating material containing a reactive functional group such as an epoxide followed by reacting the surface anchored epoxide with an amine such as a primary and a second amine, and the like providing a ring opening product which is an amino alcohol derivative on the surface thereof. Thus, for example, the silylation of Aerosil 200 with 3-glycidoxypropyl trimethoxy silane enables a silylated Aerosil with the glycidoxypropyl group chemically attached to the Aerosil surface as illustrated in working Example XIII of the present application. Subsequent treatment of the 3-glycidoxypropyl containing Aerosil with an amine such as 1-(2-amino ethyl piperazine) enables a ring opening amino product which is attached to the Aerosil's surface as illustrated in wrorking Example XIV of the present application. Further treatment of the modified Aerosil surface with an alkylating material or acid, as indicated herein, provides a surface anchored quaternary ammonium salt. Also, the flow additives can be treated with aminosilane derivatives, followed by the reaction thereof with an alkylating agent, permitting a product containing quaternary ammonium salts with different anions as illustrated in working Examples VIII and X.

Illustrative examples of specific formed quaternary ammonium salts may include cetyl pyridinium chlorides, reference U.S. Pat. No. 4,298,672, the disclosure of which is totally incorporated herein by reference; dimethyl ammonium ethyl sulfate; stearyl phenethyl dimethyl ammonium tosylate; cetyl pyridinium tetrafluoroborate; quaternary ammonium sulfate; and sulfonate charge control agents as illustrated in U.S. Pat. No. 4,338,390, the disclosure of which is totally incorporated herein by reference; alkyl ammonium sulfates, reference U.S. Pat. No. 4,560,635, entitled Toner Compositions With Ammonium Sulfate Charge Enhancing Additives, the disclosure of which is totally incorporated herein by reference; and the like.

Illustrative examples of suitable toner resins selected for the toner and developer compositions of the present invention include polyamides, epoxy resins, polydiolefins, polyurethanes, vinyl resins and polymeric esterification products of a dicarboxylic acid, and a diol comprising a diphenol. Typical vinyl monomers include styrene, p-chlorostyrene vinyl naphthalene unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, acrylamide, vinyl ethers, such as vinyl methyl ether, vinyl isobutyl ether, and vinyl ethyl ether, and N-vinyl indole, and N-vinyl pyrrolidone. In addition, particularly useful as toner resins are styrene butadiene copolymers, crosslinked and uncrosslinked polymers, and mixtures thereof.

As one preferred toner resin, there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bisphenol A and propylene oxide, followed by the reaction of the resulting product with fumaric acid, and branched polyester resins resulting from the reaction of dimethylterephthalate, 1,3-butanediol, 1,2-propanediol and pentaerythritol.

The resin particles are present in a sufficient, but effective amount, thus when 5 percent by weight of the modified charge enhancing additive composition of the present invention is present, and 10 percent by weight of pigment, or colorant such as carbon black, cyan, magenta, yellow, and other similar materials is contained therein, about 85 percent by weight of resin material is selected. Generally, from about 0.01 weight percent to about 15 weight percent, and preferably from about 0.1 weight percent to about 5 weight percent of the modified charge enhancing additive is selected for mixing with the toner particles; however, the charge enhancing additive of the present invention can be used in various amounts providing the objectives of the present invention are accomplished. These additives can be blended into the toner composition, incorporated in the toner during the manufacturing process, or coated on the pigment particles such as carbon black. When used as a coating, the charge enhancing additive of the present invention is present in an amount of from about 0.01 weight percent to about 15 weight percent, and preferably in an amount of from about 0.1 weight percent to about 10 weight percent.

Numerous well known suitable pigments or dyes can be selected as the colorant for the toner particles including, for example, carbon black, nigrosine dye, aniline blue, phthalocyanine derivatives, magnetites and mixtures thereof. The pigment, which is preferably carbon black, should be present in a sufficient amount to render the toner composition colored in order that it will permit the formation of a clearly visible image. Generally, the pigment particles are present in amounts of from about 3 percent by weight to about 20 percent by weight, based on the total weight of the toner composition; however, lesser or greater amounts of pigment particles can be selected provided the objectives of the present invention are achieved.

When the pigment particles are comprised of magnetites, which are a mixture of iron oxides ($FeO.Fe_2O_3$) including those commercially available as Mapico Black, these pigments are present in the toner composition in an amount of from about 5 percent by weight to about 60 percent by weight, and preferably in an amount of from about 5 percent by weight to about 40 percent by weight.

Also embraced within the scope of the present invention are colored developer compositions containing toner resin particles, carrier particles, the modified change enhancing additives illustrated herein, and as pigments or colorants, magenta, cyan, and/or yellow particles, as well as mixtures thereof. More specifically, with regard to the generation of color images utilizing a developer composition containing the charge enhancing additives of the present invention, illustrative examples of magenta materials that may be selected as pigments include 2,9-dimethyl-substituted quinacridone and anthraquinone dye identified in the color index as Cl 60710; Cl Dispersed Red 15, a diazo dye identified in the color index as Cl 26050; Cl Solvent Red 10; Lithol Scarlett; Hostaperm; and the like. Illustrative examples of cyan materials that may be used as pigments include copper tetra-4(octadecyl sulfonamido)phthalocyanine; X-copper phthalocyanine pigment listed in the color index as Cl 74160; Cl Pigment Blue; and Anthrathrene Blue, identified in the color index as Cl 69810, Special Blue X-2137; Sudan Blue; and the like; while illustrative examples of yellow pigments that may be selected include diarylide yellow 3,3-dichlorobenzidene acetoacetanilides, a monazo pigment identified in the color index as Cl 12700; Cl Solvent Yellow 16, a nitrophenyl amine sulfonamide identified in the color index as Foron Yellow SE/GLN; Cl Dispersed Yellow 33, 2,5-dimethoxy-4-sulfonanilide phenylazo-4'-chloro-2,5-dimethoxy aceto-acetanilide; Permanent Yellow FGL; and the like; other dyes, particularly infrared absorbing dyes useful are described in U.S. Pat. No. 4,539,284, the disclosure of which is totally incorporated herein by reference. These pigments when used with the charge enhancing additives of the present invention are generally present in the toner composition in an amount of from about 2 weight percent to about 15 weight percent based on the weight of the toner resin particles.

Illustrative examples of carrier components that can be selected for mixing with the toner particles of the present invention include those particles that are capable of triboelectrically obtaining a charge of opposite polarity to that of the toner particles. Accordingly, the carrier particles of the present invention can be selected to be of a negative polarity to permit the toner particles which are positively charged to adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area.

The selected carrier particles can be used with or without a coating, the coating generally containing fluoropolymers, such as polyvinylidenefluoride resins, poly(chlorotrifluoroethyl), fluorinated ethylene and propylene copolymers; terpolymers of styrene, methylmethacrylate, and a silane, such as triethoxy silane, polytetrafluoroethylene, fluorine containing polyacrylates, and polymethacrylates; copolymers of vinyl chloride; and trichlorofluoroethylene; and other known coatings selected for obtaining negatively charged carriers.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner composition of the present invention can be prepared by a number of known methods, including mechanical blending and melt blending the toner resin particles, pigment particles or colorants, and the modified charge enhancing additive of the present invention, followed by mechanical attrition. Other methods include those well known in the art such as spray drying, mechanical dispersion, melt dispersion, dispersion polymerization, and suspension polymerization. In one dispersion polymerization method, a solvent dispersion of the resin particles, the pigment particles, and the modified charge enhancing additive are spray dried under controlled conditions to result in the desired product. In another method, the toner compositions of the present invention can be prepared by mixing the modified charge control additives with prefabricated toners and colored toners. These additives are attached to the toner particles by thermal, mechanical, and chemical methods enabling additive particles that are situated on the surface of the larger toner particles. Toner compositions prepared in this manner result in a positively charged toner composition in relation to the carrier materials selected, and these materials exhibit the improved properties as mentioned hereinbefore.

In addition, the toner and developer compositions of the present invention may be selected for use in developing images in electrophotographic imaging systems, containing therein conventional photoreceptors providing that they are capable of being charged negatively. This usually occurs with hole transporting organic photoreceptors illustrative examples of which include layered photoresponsive devices comprised of transport layers and photogenerating layers, reference U.S. Pat. Nos. 4,265,990; 4,585,884; 4,584,253; and 4,563,408, the disclosures of which are totally incorporated herein by reference, and other similar layered photoresponsive devices. Examples of photogenerating layers include, selenium, selenium alloys, trigonal selenium, metal phthalocyanines, metal free phthalocyanines and vanadyl phthalocyanines, while examples of charge transport layers include the diamines as disclosed in the U.S. Pat. No. 4,265,990. Other photoresponsive devices useful in the present invention include polyvinylcarbazole 4-dimethylaminobenzylidene; 2-benzylidene-aminocarbazole, 4-dimethamino-benzylidene; (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoaxzole; 3-aminocarbazole; hydrazone derivatives; polyvinyl carbazole-trinitrofluorenone charge transfer complex; and mixtures thereof.

Although the toner composition triboelectric charge is dependent on a number of factors including the carrier selected, generally this charge is from about 0.5 to about 3 femtocoulombs per micron; however, toner compositions with other charge valves thereon may be useful providing the objectives of the present invention are achievable.

The following examples are being submitted to further define various species of the present invention, it being noted that these examples are intended to illustrate and not limit the scope of the present invention. Parts and percentages are by weight unless otherwise indicated.

In the following examples, the silica used was Degussa Corporation Aerosil 200, which is a chemically unmodified fumed silica with an average primary particle size of 7 to 12 nanometers. All reactions were accomplished under an inert (Argon) gas atmosphere, and where appropriate, the reaction progress was monitored by analyzing the chemical reactant in solution with gas phase chromatography and infrared spectroscopy. After the reactions were complete, the solvent and unreacted chemicals were removed by centrifugation/washing with solvent and evaporated in a vacuum. All materials were ground in a mini-blender with a rotor speed of 28,000 rpm until maximum reduction in particle size was achieved as indicated.

EXAMPLE I

Degussa Aerosil 200 silica (10.0 grams) was placed into a glass liner in a stainless steel pressure reactor and heated to 145° C. under an Argon gas purge for 10 minutes. After cooling the reactor to room temperature, 6.2 grams of N,N-dimethylaminoethanol (DMAE) was added to the reactor outside of the glass liner and 0.89 grams of DMAE was added into the inside of the glass liner near the bottom with the Aerosil. The reactor was quickly evacuated to 0.15 millimeter of mercury (Hg) and heated slowly to 300° C. The reactor's temperature was maintained at 300° C. for 5.0 hours. Thereafter, the reactor was cooled to room temperature, and the solid reaction product powder was passed through a 210 microns square opening sieve. Subsequently, the aforementioned powder was dried under vacuum at 100° C. for 4.0 hours and pulverized in a blender at 28,000 rpm.

Infrared *(powder): Silanol HO—Si≡ peak (3,751 $cm^{-1}$) was absent from the modified silica indicating that the hydroxyl groups of the silica had been reacted. New peaks appeared at 2,951 (w); 2,821 (vw); 2,784 (vw); and 1,463 (m) $cm^{-1}$.

*Symbols for the IR data for all the Examples presented herein are as follows:

*vw=very weak; w=weak; m=medium; s=strong; br=broad; vbr=very broad; shld=shoulder; and dblt=doublet.

EXAMPLE II

Aerosil 200 (5.0 grams) was thoroughly mixed with 1.11 grams of N-β-aminoethyl-gamma-propyltrimethoxysilane (Dow Corning Z-6020 silane) and 100 milliliters of dichloromethane solvent for 15 minutes. The solvent was gradually removed by flash evaporation and the resulting solid was ground to a powder. This powder was further ground in a high speed blender at 28,000 rpm.

Infrared (powder): Silanol Peak (3,751 $cm^{-1}$) disappeared, and new peaks appeared at 2,868 (m, br) and 1,458 (m, br) $cm^{-1}$.

EXAMPLE III

The product of Example II (1.7 grams) was heated under vacuum at 120° C. for 1.5 hours to remove any adsorbed chemicals.

Infrared (powder): Part of broad 2868 $cm^{-1}$ peak diminished with a peak growing at 2,928 $cm^{-1}$ (m) as compared to Example II.

EXAMPLE IV

Aerosil 200 silica (10.0 grams) was stirred with 1.75 grams of 1-(4-methylpiperazino)propanol and 200 milliliters of the solvent dichloromethane for 15 minutes. Thereafter, the solvent was removed by rotary evaporation under a reduced pressure. The product was dried under vacuum at 50° C. for 0.5 hour, and ground to a powder in a blender at 28,000 rpm.

Infrared (powder): Silanol peak (3,751 $cm^{-1}$) had disappeared. New peaks appeared at 3,010 (vw); 2,950 (vw); 1,475 (m, dblt) and 1,420 (vw) $cm^{-1}$.

EXAMPLE V

The product of Example IV (9.7) grams was heated slowly to 173° C. under Argon over a period of 1.5 hours. The cooled product was in the form of a fine powder.

Infrared (powder): Silanol peak (3,751 $cm^{-1}$) had disappeared. New peaks appeared at 3,010 (vw); 2,950 (vw); 1,475 (m, dblt) and 1,420 (vw) $cm^{-1}$.

EXAMPLE VI

Aerosil 200 silica (10.0 grams) was stirred in a solution of 2.74 grams of 1,5-dimethyl-1,5-diazaundecamethylene polymethobromide, hexamethrine bromide (Polybrene, Aldrich Chemical Company) in 10 millimeters of water and 145 millimeters of methanol for 15 minutes at room temperature. Thereafter, the solvent was removed by rotary evaporation under a reduced pressure. The product resulting was then ground to a powder, dried under vacuum at 100° C. for 1.5 hours, and further ground in a blender at 28,000 rpm.

Infrared (powder): New peaks appeared at 3,100 (vw); 2,950 (vw); 1,475 (m, dblt) and 1,420 (vw) $cm^{-1}$.

EXAMPLE VII

Aerosil 200 silica (10.0 grams) was stirred with 1.90 grams of 3-(4-methylpiperazino)propanol and 200 millimeters of dichloromethane at room temperature for 15 minutes. Thereafter, the solvent was removed by rotary evaporation at a reduced pressure and the solid was pulverized and dried under vacuum at 45° C. for 1 hour. The powder was then sealed in a heavy-walled glass tube at 0.65 millimeter Hg and heated at 250° C. for 5 hours. After cooling, the powder was dried under vacuum at 100° C. for 2.5 hours and ground in a blender at 28,000 rpm.

Infrared (powder): Silanol peak (3,751 $cm^{-1}$) has disappeared. New peaks appeared at 2,944 (m); 2,814 (m); 1,457 (m, dblt) and 1372 (m) $cm^{-1}$.

EXAMPLE VIII

The product of Example II (1.23 grams ) was stirred with 0.155 gram of dimethyl sulfate and 30 millimeters of acetone at room temperature for 26.5 hours. Gas phase chromatography indicated that approximately 95 percent of the dimethyl sulfate had reacted. The flow aid product comprising quaternary ammonium salts was collected by centrifugation, washed with diethyl ether, and dried in air. Thereafter, the material was pulverized, dried under vacuum at 100° C. for 4 hours and ground in a blender at 28,000 rpm.

Infrared (powder): Peak at 2,868 $cm^{-1}$ had disappeared. New peaks appeared at 3,032 (vw); 2,947 (w); 1,465 (m, dblt) and 751 (m) $cm^{-1}$.

EXAMPLE IX

The product of Example VII (1.50 grams) was reacted with 0.277 gram of methyl-4-toluene sulfonate in 30 milliliters of acetone under reflux conditions for 24.5 hours. Gas phase chromatography indicated that approximately 80 percent of the dimethyl sulfate had reacted. The resulting product was then collected by centrifugation, washed with diethyl ether, air-dried and then dried under vacuum at 100° C. for 4 hours. Thereafter, the resulting flow aid comprising quaternary ammonium salts was ground in a blender at 28,000 rpm.

Infrared (powder): Peaks at 2,814 and 1,372 $cm^{-1}$ had disappeared. New peaks appeared at 3,029 (vw); 2,854 (w); and 678 (m) $cm^{-1}$. Peak at 1,457 $cm^{-1}$ appeared to shift to 1,470 $cm^{-1}$ (br).

EXAMPLE X

The product of Example II (1.50 grams) was refluxed with a 0.190 gram of benzyl chloride and 30 milliliters of n-heptane for 18 hours, and the solvent was removed by rotary evaporation under a reduced pressure. The resulting flow aid comprising quaternary ammonium salts was then refluxed with an additional 0.190 gram of benzyl chloride and 30 milliliters of methylethyl ketone for 88 hours. The product was collected by centrifugation, washed with diethylether, air dried, then dried under a vacuum at 100° C. for 4 hours, and ground in a blender at 28,000 rpm.

Infrared (powder): New peaks appeared at 3,062 (vw); 3,025 (vw); 2,940 (w); 2,800 (w); 1,492 (w); 1,451 (m); 741 (w) and 694 (w) $cm^{-1}$.

EXAMPLE XI

The product of Example VII (3.08 grams) was refluxed with a 0.398 gram of benzyl chloride and 50 milliliters of n-heptane for 16 hours, and the solvent was removed by rotary evaporation under a reduced pressure. The solid product resulting was then refluxed with an additional 0.392 gram of benzyl chloride and 50 milliliters of methylethyl ketone for 88 hours. Thereafter, the resulting flow aid comprising quaternary ammonium salts product was collected by centrifugation, washed with diethylether, air dried, then dried under vacuum at 100° C. for 4 hours, and ground in a blender at 28,000 rpm.

Infrared (powder): Peaks at 2,814 and 1,457 $cm^{-1}$ had disappeared. New peaks appeared at 1,473 (m); 1,454 (m); 884 (w) and 706 (w) $cm^{-1}$.

EXAMPLE XII

The product of Example VII (1.50 grams) was reacted with a 0.189 gram of dimethylsulfate and 30 milliliters of acetone under Argon gas at room temperature for 28.5 hours. Gas phase chromatography indicated that more than 95 percent of the dimethyl sulfate had reacted. The resulting flow aid comprising quaternary ammonium salts product was collected by centrifugation, washed with diethylether, air-dried, then dried under vacuum at 100° C. for 4 hours, and ground in a blender at 28,000 rpm.

Infrared (powder): Peaks at 2,944, 2,814 and 1,457 $cm^{-1}$ had disappeared. New peaks appeared at 3,432 (m, vbr); 2,952 (w); 1,474 (m) and 754 (w) $cm^{-1}$.

EXAMPLE XIII

Aerosil 200 silica (10.0 grams) was mixed with 2.36 grams of 3-glycidoxypropyltrimethoxy silane and 200 milliliters of dichloromethane at room temperature for 30 minutes. To this mixture was added a solution of 10 milliliters of methanol and 50 milliliters of dichloromethane. After 45 minutes, the dichloromethane solvent was removed by flash evaporation at a reduced pressure and the resulting solid was dried under vacuum at 80° C. for 2 hours. Ten grams of the solid was stirred with a solution of 1.14 grams of 1-(2-aminoethyl)piperazine and 250 milliliters of dichloromethane at room temperature for 2 hours at which time the solvent was removed by rotary evaporation under a reduced pressure. Thereafter, the resulting product solid was heated at 100° C. for 1 hour, dried under vacuum at 100° C. for 2 hours, and ground in a blender at 28,000 rpm.

Infrared (powder): Silanol peak (3,751 $cm^{-1}$) had disappeared. New peaks appeared at 3,364 (m, br); 2,939 (m); 2,814 (m) and 1,457 (m) $cm^{-1}$.

EXAMPLE XIV

The product of Example XIII (5.0 grams) was refluxed with 0.563 gram of dimethylsulfate and 100 milliliters of acetone under Argon for 50 hours. The resulting flow aid comprising quaternary ammonium salts product was collected by centrifugation, washing with acetone and then diethylether. The solid was air-dried, then dried under vacuum at 100° C. for 2 hours, and ground in a blender at 28,000 rpm.

Infrared (powder): Peak at 2,814 $cm^{-1}$ had disappeared. New peak appeared at 757 (w) $cm^{-1}$. Peak at 3,364 $cm^{-1}$ appeared to shift to 3,404 $cm^{-1}$.

EXAMPLE XV

Each of the above prepared, Examples I to XIV, modified flow aid additives at a concentration of 0.5 percent by weight were blended on a ball mill for 30 minutes with a toner (CZ0708) consisting of 15 percent Mapico Black and 5 percent Regal® 330 carbon black blended into a Pliolite resin, 80 percent by weight, which is a copolymer of styrene and butadiene resin followed by jetting to an average particle size of 10 microns. The resulting toners were then blended at a concentration of 2 percent to 15 minutes with magnetic carrier beads consisting of 1.2 percent FPC461, a vinylchloride-chlorotrifluoroethylene copolymer containing 10 percent Vulcan XC72R carbon black fluid bed coated on ferrite (FB412) and/or steel grit (FB421) cores.

The charge level and charge distribution for the above developer compositions were then characterized on a charge spectrograph, which measures the charge to diameter ratio (Q/D) of the individual toner particles. An average Q/D of above one femtocoulomb/micron is desirable.

The S value which is a measure of the narrowness of the charge distribution for the toner compositions was calculated by dividing the average Q/D value (charge to diameter ratio of the toner particles as measured on the charge spectrograph) by the standard deviation for the same Q/D value for 10 micron average diameter toner particles. The S value should preferably be above 3 to avoid toner particles with a low, for example 0.2 femtocoulombs (fc/um) per micron charge thereby assisting in eliminating dirt and toner background deposits on the final image copy.

Also, the admix time which is a measure of the time period required for uncharged toner added, for example to an imaging apparatus, to attach charge levels typical of the toner already present in the apparatus was measured by adding 1 percent of uncharged toner to a developer (toner plus carrier) that has already been mixed for 15 minutes at a 2 percent toner concentration, and then sampling the developer at different times to determine where it attains a single peak. This is referred to as the admix time. Short admix times are preferably desired for developers selected for xerographic processes, that is for example admix times of 5 minutes or less.

The aforementioned results are reported in Table 1.

TABLE 1

ELECTRICAL PROPERTIES OF CHEMICALLY MODIFIED SILICA(AEROSIL)SAMPLES

| Silica* Example No. | Toner | Carrier | Q/D (fc/μm) | S | Admix Time (Min.) |
|---|---|---|---|---|---|
| None | CZ0708 | FB412[a] | 0.53 | 3.70 | 30.0 |
| Untreated Aerosil 200 | CZ0708 | FB412 | 0.29 | 2.33 | 15.0 |
| I | CZ0708 | FB412 | 1.02 | 5.30 | 5.0 |
| II | CZ0708 | FB412 | 2.30 | 3.82 | 1.0 |
| III | CZ0708 | FB412 | 2.23 | 3.28 | 1.0 |
| IV | CZ0708 | FB412 | 1.02 | 6.20 | 1.0 |
| V | CZ0708 | FB412 | 0.71 | 4.90 | 15.0 |
| VI | CZ0708 | FB412 | 1.14 | 5.00 | 1.0 |
| Untreated | CZ0708 | FB421[b] | −0.18 | 0.80 | <30.0 |
| IV | CZ0708 | FB421 | 1.09 | 6.59 | 1.0 |
| V | CZ0708 | FB421 | 1.14 | 6.26 | 1.0 |
| VI | CZ0708 | FB421 | 0.72 | 5.27 | 15.0 |
| VII | CZ0708 | FB421 | 1.22 | 6.76 | 2.0 |
| VIII | CZ0708 | FB421 | 1.34 | 4.70 | 1.0 |
| IX | CZ0708 | FB421 | 1.13 | 5.96 | 1.0 |
| X | CZ0708 | FB421 | 2.16 | 3.65 | 1.0 |
| XI | CZ0708 | FB421 | 1.20 | 5.29 | 2.0 |

TABLE 1-continued

ELECTRICAL PROPERTIES OF CHEMICALLY MODIFIED SILICA(AEROSIL)SAMPLES

| Silica* Example No. | Toner | Carrier | Q/D (fc/μm) | S | Admix Time (Min.) |
|---|---|---|---|---|---|
| XII | CZ0708 | FB421 | 0.81 | 5.73 | 1.0 |
| XIII | CZ0708 | FB421 | 1.43 | 4.71 | 2.0 |
| XIV | CZ0708 | FB421 | 1.49 | 5.49 | 2.0 |

*Concentration of the silica charge enhancing additives selected was 0.5 weight percent based on the weight of toner.

[a]100 average diameter ferrite core with a coating of 1.2 percent FP461 fluoropolymer (based on the ferrite) and 10 percent Vulcan XC72R carbon black therein (based on polymer coating).

[b]same as [a] with the exception that the ferrite is replaced with a steel grit carrier core.

EXAMPLE XVI

Four grams of Aerosil 300 silica was mixed with 1.41 grams of 4,4'-bis(dimethylamino)benzhydrol and 80 milliliters of tetrahydrofuran solvent at room temperature for 15 minutes. The materials reacted quickly converting the silica to a strong, dark blue color. The solvent was then removed by flash evaporation, and the solid product resulting was dried under vacuum at 100° C. for 3 hours. Thereafter, the powder was ground in a blender at 28,000 rpm with the color persisting in the ground material.

Infrared (powder, compared with unmodified Aerosil 300): Silanol peak was absent from the modified silica. New peaks appeared at 1,612 (s); 1,604 (shld, m); 1,517 (s) and 1,341 (m) $cm^{-1}$.

EXAMPLE XVII

The process of Example XVI was repeated with the exception that 5.0 grams of Degussa Aluminum Oxide C was selected in place of the silica, and 0.676 gram of the 4,4'-bis(dimethylamino)-benzhydrol was selected.

Infrared (power, compared with unmodified Aluminum Oxide C): New peaks appeared at 1,600 (s); 1,519 (s); 1,329 (m) and 983 (m) $cm^{-1}$.

EXAMPLE XVIII

The process of Example XVI was repeated with the exception that 5.0 grams of Degussa hydrophobic Aerosil R974 silica was selected in place of the Aerosil 300, and 0.541 gram of the 4,4'-bis(dimethylamino)benzhydrol was selected. The resulting silica product was dark blue in color.

Infrared (power, compared with unmodified Aerosil R974): New peaks appeared at 1,612 (s); 1,604 (shld, m); and 1,518 (s) $cm^{-1}$.

EXAMPLE XIX

Five grams of Degussa hydrophobic Aerosil R974 silica was mixed with 0.22 gram of 2-amino-3-hydroxy pyridine and 80 milliliters of tetrahydrofuran at room temperature for 15 minutes. The solvent was then removed by flash evaporation and the solid product resulting was dried under vacuum at 100° C. for 5 hours. The powder was then ground in a blender at 28,000 rpm.

Infrared (powder, compared with unmodified Aerosil 974): New peaks appeared at 1,627 (m) and 1,477 (m) $cm^{-1}$.

EXAMPLE XX

Modified, reference Examples IV, VII, IX, X, XI, XII, XIII, XIV, XVI, XVII, XVIII, and XIX, and unmodified flow aid components were electrically tested by repeating the procedure of Example XV, wherein the amount of additive selected was 0.5 percent by weight, and the toner was CZ0708, with the following results:

TABLE 2

ELECTRICAL PROPERTIES OF CHEMICALLY MODIFIED SILICA(AEROSIL)SAMPLES

| Silica* Example No. | Toner | Carrier | Q/D (fc/μm) | S | Admix Time (Min.) |
|---|---|---|---|---|---|
| IV(treated Aerosil 200) | CZ0708 | FB412 | 1.26 | 4.9 | 0.25 |
| VII(treated Aerosil 200) | CZ0708 | FB412 | 1.26 | 4.0 | 0.25 |
| IX(treated Aerosil 200) | CZ0708 | FB412 | 1.46 | 4.5 | 0.25 |
| X(treated Aerosil 200) | CZ0708 | FB412 | 2.43 | 3.1 | 0.25 |
| XI(treated Aerosil 200) | CZ0708 | FB412 | 1.33 | 6.1 | 0.50 |
| XII(treated Aerosil 200) | CZ0708 | FB412 | 1.10 | 4.4 | 0.25 |
| XIII(treated Aerosil 200) | CZ0708 | FB412 | 1.80 | 4.2 | 0.50 |
| XIV(treated Aerosil 200) | CZ0708 | FB421[b] | 1.89 | 4.0 | 0.25 |
| Untreated Aerosil 300 | CZ0708 | FB421 | 0.08 | 0.5 | 15.00 |
| XVI(treated Aerosil 300) | CZ0708 | FB421 | 0.93 | 5.0 | 1.00 |
| XVII(treated Aluminum Oxide C) | CZ0708 | FB421 | 1.50 | 3.6 | 0.50 |
| Untreated Aerosil R974 Hydrophobic | CZ0708 | FB421 | 0.15 | 1.0 | 15.00 |
| XVIII (treated Aerosil R974) | CZ0708 | FB421 | 0.66 | 3.6 | 0.25 |
| XIX(treated Aerosil R974) | CZ0708 | FB421 | 0.64 | 4.3 | 0.25 |

EXAMPLE XXI

There was prepared a toner composition by melt blending, followed by mechanical attrition comprised of poly(styrene-co-butadiene) (92 percent styrene, 8 percent butadiene, available as Pliolite SS), 89.6 percent by weight; 9.6 percent by weight of the pigment Lithol Scarlett; and 0.8 percent by weight of a magenta colorant Hostaperm Pink. Thereafter, the resulting toner composition was classified to remove particles with an average diameter smaller than 5 microns.

Subsequently, the triboelectric properties of the aforementioned prepared classified toner with and without modified flow aid additives were determined by repeating the procedure of Example XV with the following results:

TABLE 3

ELECTRICAL PROPERTIES OF CHEMICALLY MODIFIED FLOW AID COMPONENTS

| Flow Aid (Silica)[a] | Toner[b] | Carrier[c] | Q/D (fc/μm) | S | Admix Time (Min.) |
|---|---|---|---|---|---|
| None | CX0923 | FB412 | 1.60 | 5.4 | 10.0 |
| Example VII | CX0923 | FB412 | 2.21 | 3.4 | 1.5 |
| Example X | CX0923 | FB412 | 2.54 | 2.2 | 1.0 |

[a]Concentration of modified silica (modified Aerosil 200) is 0.5 percent based on the weight of toner.
[b]Red toner concentration is 2 percent based on the weight of magnetic carrier beads (FX412).
[c]See description in Example XV for details.
Q/D, S, Admix Time, and FB412 are as illustrated with respect to Example XV.

Other modifications of the present invention may occur to those skilled in the art subsequent to a review of the present application. The aforementioned modifications, including equivalents thereof are intended to be included within the scope of the present invention.

What is claimed is:

1. A positively charged developer composition comprising carrier particles and a toner composition containing resin particles, pigment particles, and modified charge enhancing additives comprising flow aid compositions having chemically bonded thereto, or chemiadsorbed onto the surface thereof, amino alcohol derivatives of the formula

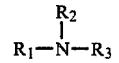

wherein $R_1$, $R_2$ and $R_3$ are substituents independently selected from the group consisting of hydrogen, alkyl, substituted alkyl, phenyl, naphthyl, substituted phenyl, substituted naphthyl, amino, heterocyclic components containing nitrogen, oxygen, or sulfur; unsaturated substituents; and aliphatic cyclic substituents, subject to the provision that at least one of the $R_1$, $R_2$ or $R_3$ substituents comprise a hydroxyl group.

2. A developer composition in accordance with claim 1 wherein the amino alcohol is selected from the group consisting of 2-(N,N-dimethylamino)ethanol, 2-(N,N-diethylamino)ethanol, 4,4'-bis(dimethylamino)benzhydrol, 1-(4-methylpiperazino)propanol, 1,3-bis(dimethylamino)-2-propanol, and Malachite Green Carbinol base.

3. A developer composition in accordance with claim 1 wherein the flow aid compositions are hydrophobic or hydrophilic.

4. A developer composition in accordance with claim 1 wherein the flow aid compositions are selected from the group consisting of silicas, aluminum oxides, and titanium oxides.

5. A developer composition in accordance with claim 1 wherein the resin particles are selected from the group consisting of polyesters, styrene butadiene copolymers, or styrene methacrylate copolymers.

6. A developer composition in accordance with claim 1 wherein the pigment particles are selected from the group consisting of carbon black and magnetite.

7. A developer composition in accordance with claim 1 wherein the pigment particles are selected from the group consisting of magenta, cyan, yellow, and mixtures thereof.

8. A developer composition in accordance with claim 1 wherein the charge enhancing additive moiety which is chemically bonded to or chemiabsorbed onto the surface of the flow aid composition is prepared by treating the flow aid composition with an epoxide-containing silylating agent, and thereafter reacting the resulting composition with a primary amine, or a secondary amine.

9. A developer composition in accordance with claim 8 wherein the flow aid can be hydrophobic or hydrophilic.

10. A developer composition in accordance with claim 8 wherein the resin particles are selected from polyesters, styrene butadiene copolymers, or styrene methacrylate copolymers.

11. A developer composition in accordance with claim 8 wherein the pigment is selected from the group consisting of carbon black and magnetite.

12. A developer composition in accordance with claim 8 wherein the pigment is cyan, magnetite, yellow, or mixtures thereof.

13. A toner composition in accordance with claim 8 wherein the flow aid composition is an aluminum oxide or silica.

14. A developer composition in accordance with claim 1 wherein the carrier particles are comprised of a steel core or a ferrite core.

15. A developer composition in accordance with claim 1 wherein the carrier particles include a coating thereover.

16. A developer composition in accordance with claim 15 wherein the coating is a polychlorotrifluoroethylene-co-vinylchloride copolymer, a polyvinylidene fluoropolymer, a terpolymer of styrene, methacrylate, and vinyltriethoxysilane, fluorinated ethylene-propylene copolymers, or polytetrafluoroethylene.

17. A developer composition in accordance with claim 8 wherein the carrier particles are comprised of a steel core or a ferrite core.

18. A developer composition in accordance with claim 8 wherein the carrier particles include a coating thereover.

19. A developer composition in accordance with claim 18 wherein the coating is a polychlorotrifluoroethylene-co-vinylchloride copolymer, a polyvinylidene fluoropolymer, a terpolymer of styrene, methacrylate, and vinyltriethoxysilane, fluorinated ethylene-propylene copolymers, or polytetrafluoroethylene.

20. A method of imaging which comprises the generation of an electrostatic latent image on an imaging member; thereafter developing the aforementioned image with the developer composition of claim 1; subsequently transferring the image to a suitable substrate; and optionally permanently affixing the image thereto.

21. A method of imaging which comprises the generation of an electrostatic latent image on an imaging member; thereafter developing the aforementioned image with the developer composition of claim 8; subsequently transferring the image to a suitable substrate; and optionally permanently affixing the image thereto.

22. A method of imaging in accordance with claim 20 wherein the amino alcohol is selected from the group consisting of 2-(N,N-dimethylamino)ethanol, 2-(N,N-diethylamino)ethanol, 4,4'-bis(dimethylamino)benzhydrol, 1-(4-methylpiperazino)propanol, 1,3-bis(dimethylamino)-2-propanol, and Malachite Green Carbinol base.

23. A single component toner composition comprised of resin particles, pigment particles, and the modified charge enhancing additives of claim 1.

24. A single component toner composition comprised of resin particles, pigment particles, and the modified charge enhancing additives of claim 8.

25. A toner composition in accordance with claim 23 wherein the pigment particles are comprised of magnetites.

26. A toner composition in accordance with claim 24 wherein the pigment particles are comprised of magnetites.

27. A single component toner composition in accordance with claim 23 wherein the modified charge enhancing additives contain flow aid compositions selected from the group consisting of silicas, aluminum oxides, and titanium oxides.

* * * * *